US009714128B2

(12) United States Patent
Matta

(10) Patent No.: US 9,714,128 B2
(45) Date of Patent: Jul. 25, 2017

(54) CUSHIONING PACKAGE

(71) Applicant: OFFMAR S.r.l., Arignano (IT)

(72) Inventor: Guido Matta, Arignano (IT)

(73) Assignee: OFFMAR S.R.L., Arignano (Turin) (IT)

( * ) Notice: Subject to any disclaimer, the term of this patent is extended or adjusted under 35 U.S.C. 154(b) by 0 days.

(21) Appl. No.: 14/683,949

(22) Filed: Apr. 10, 2015

(65) Prior Publication Data

US 2015/0314940 A1 Nov. 5, 2015

(30) Foreign Application Priority Data

Apr. 9, 2014 (IT) ..... TO2014A0303

(51) Int. Cl.

| | |
|---|---|
| ***B65D 81/03*** | (2006.01) |
| ***B65D 81/05*** | (2006.01) |
| ***B65D 65/38*** | (2006.01) |
| ***B65D 75/58*** | (2006.01) |

(52) U.S. Cl.

CPC ..... *B65D 81/052* (2013.01); *B65D 65/38* (2013.01); *B65D 75/58* (2013.01); *B65D 2581/053* (2013.01)

(58) Field of Classification Search

CPC ..... B65D 81/03; B65D 81/052; B65D 27/00; B42D 15/08; B42D 5/025; B31B 37/00

USPC ..... 206/522, 484; 229/68.1, 72; 383/110, 3

See application file for complete search history.

(56) References Cited

U.S. PATENT DOCUMENTS 3,318,759 A * 5/1967 Anderson ..... B65D 75/30 206/484
4,551,379 A * 11/1985 Kerr ..... B31D 5/0073 206/522
5,263,587 A * 11/1993 Elkin ..... B65D 81/052 206/522
5,996,798 A * 12/1999 Gessert ..... B65D 81/052 156/145
6,139,188 A * 10/2000 Marzano ..... B65D 81/3888 206/522
6,149,002 A * 11/2000 Tiramani ..... B65D 81/052 206/320
7,108,650 B2 * 9/2006 Marzano ..... B31B 37/00 156/257

(Continued)

FOREIGN PATENT DOCUMENTS

FR 1427205 A 2/1966
GB 809413 A 2/1959

(Continued)

OTHER PUBLICATIONS

European Search Report for corresponding European Application No. EP 15162651.2 completed on Jun. 26, 2015, and dated Jul. 3, 2015.

(Continued)

*Primary Examiner* — Steven A. Reynolds
(74) *Attorney, Agent, or Firm* — Heslin Rothenberg Farley & Mesiti, P.C.; Victor A. Cardona, Esq.

(57) ABSTRACT

A cushioning package, particularly an envelope or bag whose walls are internally lined by a cushion made of air cells consists of a row of elongated and contiguous tubular chambers parallel to each other sealed to the walls of the package and contains air at substantially environmental pressure.

14 Claims, 3 Drawing Sheets

(56) References Cited

U.S. PATENT DOCUMENTS

| | | | | |
|---|---|---|---|---|
| 7,621,104 | B2 * | 11/2009 | Piucci | B31B 37/00 53/403 |
| 8,568,029 | B2 * | 10/2013 | Kannankeril | B31B 37/00 206/522 |
| 2004/0000581 | A1 * | 1/2004 | Brandolini | B31B 37/00 229/68.1 |
| 2004/0171469 | A1 * | 9/2004 | Brandolini | B31B 37/00 493/186 |
| 2006/0169753 | A1 * | 8/2006 | Piucci | B31B 37/00 229/68.1 |
| 2006/0210773 | A1 * | 9/2006 | Kannankeril | B29C 66/7352 428/166 |
| 2011/0192121 | A1 | 8/2011 | Kannankeril et al. | |
| 2016/0023831 | A1 * | 1/2016 | Cheich | B65D 81/051 206/522 |

FOREIGN PATENT DOCUMENTS

| | | | |
|---|---|---|---|
| JP | H04 29974 | U | 3/1992 |
| JP | H0429974 | U | 3/1992 |
| JP | H07 285581 | A | 10/1995 |
| JP | H07285581 | A | 10/1995 |
| JP | H10 129731 | A | 5/1998 |
| JP | H10129731 | A | 5/1998 |
| JP | H11 1275 | A | 1/1999 |
| JP | H111275 | A | 1/1999 |
| JP | 2001 213479 | A | 8/2001 |
| JP | 2013 180812 | A | 9/2013 |
| JP | 2013180812 | A | 9/2013 |
| WO | 95/02548 | A1 | 1/1995 |

OTHER PUBLICATIONS

Italian Search report for Italian Application No. TO2014000303 filed on Apr. 9, 2014, completed on Dec. 10, 2014.

* cited by examiner

CUSHIONING PACKAGE

CROSS REFERENCE TO RELATED APPLICATIONS

This application claims priority from Italian patent application No. TO2014A000303 filed on Apr. 9, 2014 the entire disclosure of which is incorporated herein by reference.

FIELD OF THE INVENTION

The present invention relates to cushioning packages, for example in the form of paper or plastic envelopes or bags whose walls are internally lined with a cushion of air cells.

STATE OF THE ART

Traditionally, the cushion made of air cells is formed of what is commercially defined as "pluriball", or rather "bubble wrap"; two thin sheets or films of thermoplastic material, typically polyethylene, are welded together in order to delimit rows of circular-shaped cells that enclose air under pressure. The product thus formed is, in turn, applied by means of heat-welding to the inner surfaces of the walls of the envelope or bag which, in the case of paper, are in turn lined with a thermoplastic film.

This arrangement, although efficient with respect to protecting against shock of the contents of the package, is relatively complex regarding both the production of the product with air bubbles, and its application to the package.

From JP-H07285581 a cushioning package corresponding to the preamble of claim 1 is known, wherein the air cells consist of a row of elongated and contiguous tubular chambers parallel to one another. These chambers are filled up and inflated at the origin, i.e. during manufacturing of the package, with compressed air. To such effect the package requires for each tubular chamber a respective check valve connected to a common manifold formed transversely of the row of tubular chambers.

This known solution is constructively complicated and additionally involves a noticeable thickness of the package, due to the tubular chambers being inflated, and thus a relevant bulk.

SUMMARY OF THE INVENTION

The object of the present invention is to make a cushioning package available that is appreciably simpler and more economical but nevertheless equally efficient with respect to protecting its contents.

According to the invention, this object is achieved thanks to the fact that the tubular elongated and contiguous tubular chambers, parallel to each other, are hermetically sealed to the walls of the package and contain air substantially at environmental pressure.

By virtue of this solution in use the air trapped within the tubular chambers, following any deformations of the package involving squashing of the chambers, is locally compressed to an extent which is sufficient to provide the necessary protection to the package content. Such a protection is thus afforded without the need of previously inflating the chambers under high pressure, therefore avoiding the complications, costs and encumbrance deriving therefrom.

The tubular chambers, which essentially have the same length as the envelope or bag and are conveniently arranged in two superimposed layers parallelly to the two opposite sides thereof, preferably with a transverse orientation with respect to its openable end, can be advantageously formed by a simple sheet of corrugated plastic material, heat-welded along its edges and along its corrugations to the film of thermoplastic material that lines the walls of the paper envelope or bag.

In the case in which the envelope or bag, or more generally the package, is also of thermoplastic material, the corrugated sheet will be directly welded to its walls.

BRIEF DESCRIPTION OF THE DRAWINGS

The invention will now be described in detail with reference to the attached drawings, provided purely by way of non-limiting example, in which.

DETAILED DESCRIPTION OF THE INVENTION

Figure 1:
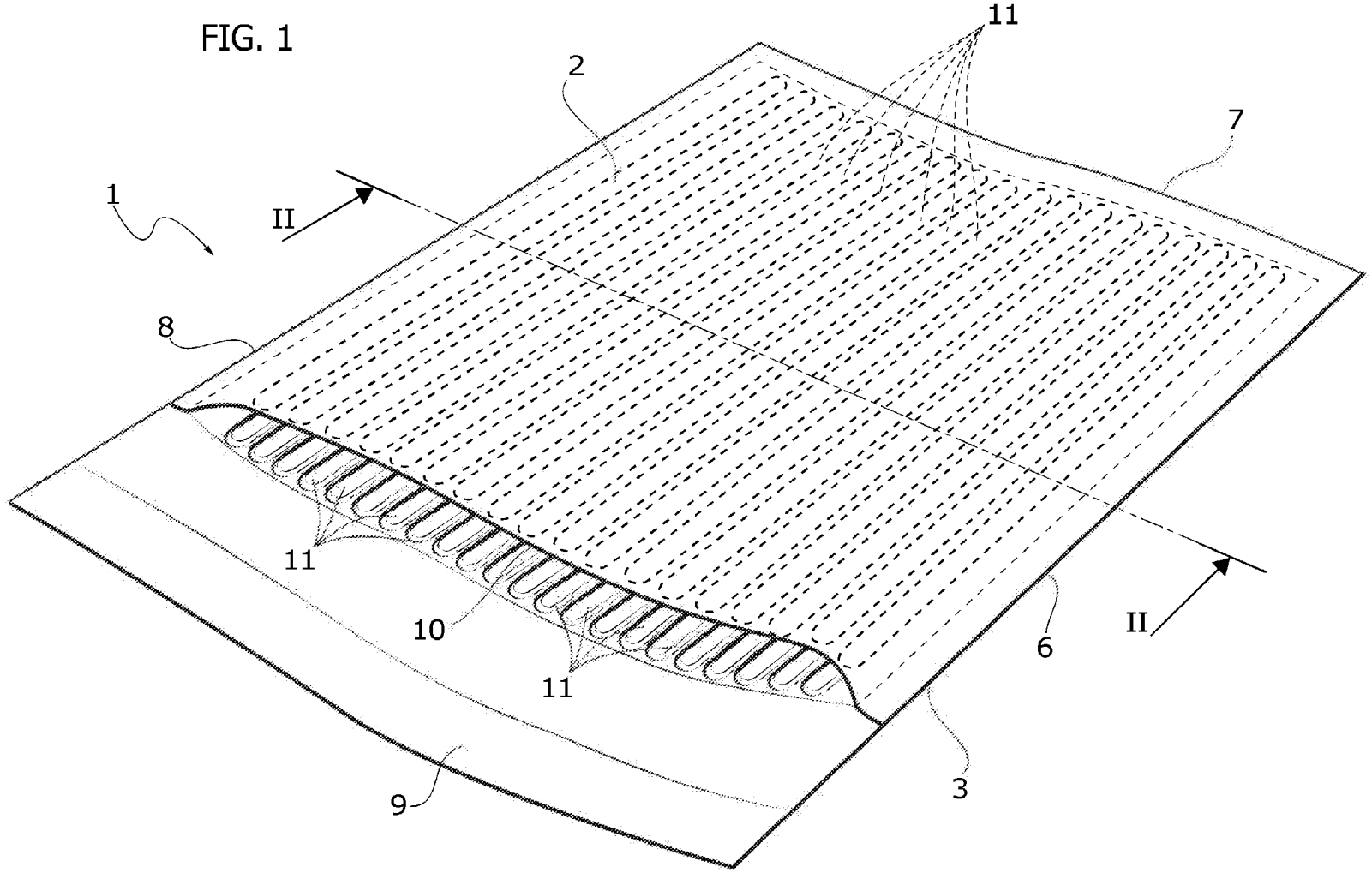
FIG. 1 is a schematic prospective view of a cushioning package, specifically of an envelope, according to the invention.
Figure 2:
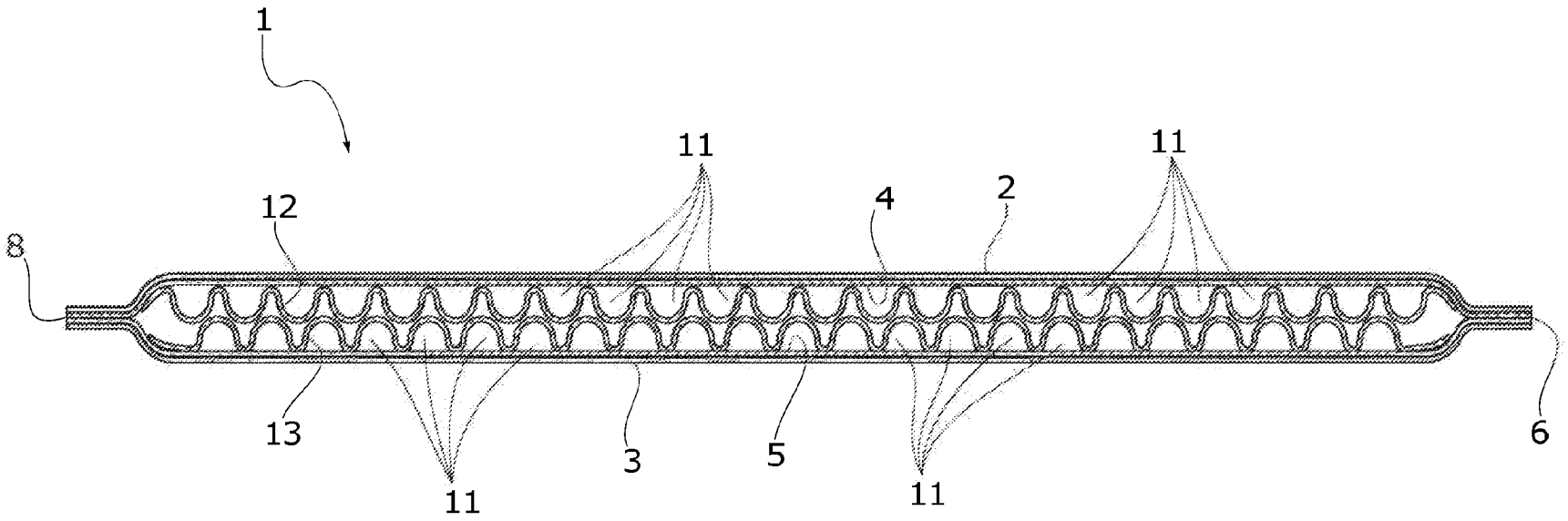
FIG. 2 is a cross-sectional view according to the line II-II of FIG. 1.
Figure 3:
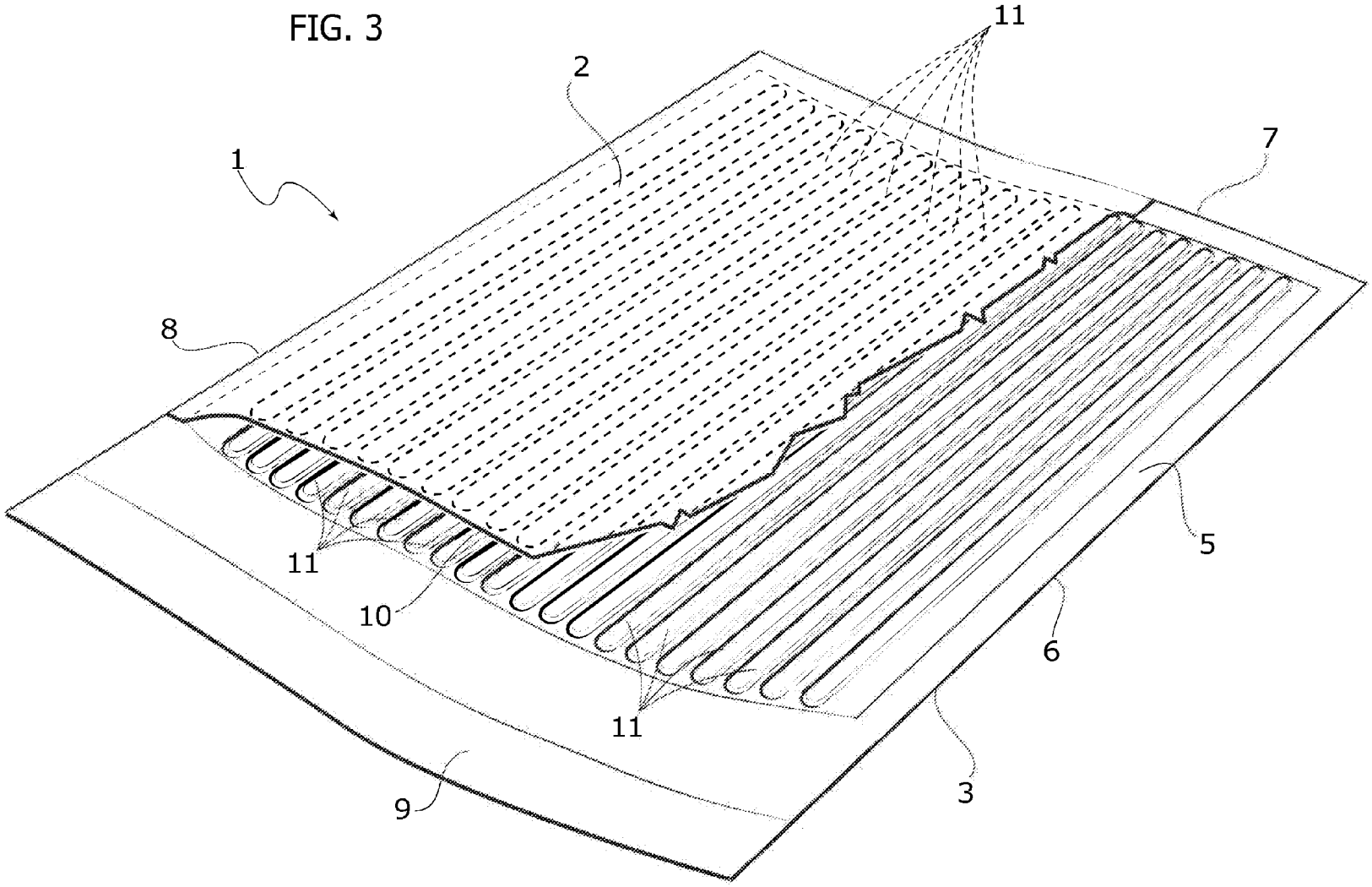
FIG. 3 is a partially broken analogous view to FIG. 1.

The example of the cushioning package according to the invention represented in the drawings relates to an envelope: it must, however, be stated that the invention is applicable to packages of different types, for example in the form of a bag or the like, both of paper and of thermoplastic material.

In the case of the example illustrated, the envelope, indicated by 1, comprises two walls 2, 3 of plastic-coated paper in the usual manner, or rather whose inner surfaces are lined with a respective thin film 4, 5 of thermoplastic material, typically polyethylene. In this way, the walls 2, 3 can be joined to each other by means of heat-welding at the respective edges along three sides 6, 7, 8. The fourth side has an opening 10 for introducing and extracting the contents of the envelope 1, for example reclosable by an appendix 9 of the wall 3 refoldable against the wall 2.

According to the unique characteristic of the invention, the walls 2 and 3 are internally lined with a cushion of air cells consisting of a row of elongated and contiguous tubular chambers 11, parallel to each other.

Preferably two superimposed layers of tubular chambers 11 are provided, extending parallelly to the sides 6, 8 of the envelope 1, i.e. transversely to the open end 10 and therefore in the direction of introducing and extracting the contents of the envelope, essentially for the entire length thereof. The tubular chambers 11 of each layer are advantageously alternated i.e. offset relative to the chambers of the other layers.

The tubular chambers 11 are conveniently formed, for each wall 2, 3, of a single corrugated sheet 12 of thermoplastic material, typically polyethylene, heat-welded along its edges and between each pair of contiguous corrugations, directly to the film 4, 5 that internally lines the wall 2, 3.

In the case in which the envelope or, more generally, the package is made of plastic instead of paper, the corrugated sheets 12, 13 will be heat-welded directly to the inner surfaces of the walls 2, 3.

The tubular chambers 11 trap therein air at environmental i.e. atmospheric pressure, or at the most slightly higher. In use, whenever these chambers 11 are squashed following any deformations of the package, the air contained at their interior is locally compressed to an extent which reveals sufficient to provide the necessary protection to the package content. Such a protection is thus afforded without the need of previously inflating the chambers under high pressure, therefore avoiding the complications, costs and encumbrance deriving therefrom.

It is apparent from the above that the cushioning package according to the invention can be manufactured so as to be appreciably simpler and more economical, also in terms of a lower quantity of material necessary for its cushioning, compared to conventional cushioning with air bubbles, while ensuring no less functional efficacy with respect to protecting its contents.

Of course, the details of construction and the embodiments may be widely varied with respect to what is described and illustrated without departing from the scope of the invention as defined by the following claims. Thus, as already explained, the form and type of package may be very different.

The invention claimed is:

1. A cushioning package comprising:

walls internally lined by a cushion made of air cells, wherein the air cells consist of a row of elongated and contiguous tubular chambers parallel to one other, and each chamber of said tubular chambers hermetically sealed to the walls of the package around an entire perimeter of each chamber and each chamber containing air at substantially environmental pressure, wherein said tubular chambers are arranged in a first layer superimposed on a second layer, and wherein first tubular chambers of said first layer are offset relative to second tubular chambers of said second layer over entire longitudinal dimensions of said first tubular chambers and said second tubular chambers, such that first longitudinal axes of said first layer and second longitudinal axes of said second layer are not aligned with each other;

each tubular chamber of the first tubular chambers is parallel to each other tubular chamber of the first tubular chambers over an entire longitudinal dimension of each tubular chamber of the first tubular chambers, each tubular chamber of the second tubular chambers is parallel to each other tubular chamber of the second tubular chambers over an entire longitudinal dimension of each tubular chamber of the second tubular chambers;

each tubular chamber of the first tubular chambers being about equal in width to each other tubular chamber of the first tubular chambers over an entire longitudinal dimension of each chamber of the first tubular chambers, and each tubular chamber of the second tubular chambers being about equal in width to each other tubular chamber of the second tubular chambers over an entire longitudinal dimension of each chamber of the second tubular chambers.

2. The package according to claim 1, wherein the walls form an envelope or bag.

3. The package according to claim 2, wherein said tubular chambers essentially have the same length as the envelope or bag.

4. The package according to claim 3, wherein said walls are made of paper coupled internally with a film of thermoplastic material wherein said tubular chambers are formed by a corrugated sheet of thermoplastic material heat-welded to said film along its edges and along its corrugations that define said tubular chambers.

5. The package according to claim 3, wherein said walls are made of thermoplastic material, wherein said tubular chambers are formed by a corrugated sheet of thermoplastic material heat-welded to said walls along its edges and along its corrugations that define said tubular chambers.

6. The package according to claim 2, wherein the envelope or bag has a quadrangular shape, wherein said tubular chambers are arranged parallelly to two opposite sides of the envelope or bag.

7. The package according to claim 6, further comprising an openable side for introducing and extracting the contents, wherein said tubular chambers are oriented transversely to said openable side.

8. The package according to claim 7, wherein said walls are made of paper coupled internally with a film of thermoplastic material wherein said tubular chambers are formed by a corrugated sheet of thermoplastic material heat-welded to said film along its edges and along its corrugations that define said tubular chambers.

9. The package according to claim 7, wherein said walls are made of thermoplastic material, wherein said tubular chambers are formed by a corrugated sheet of thermoplastic material heat-welded to said walls along its edges and along its corrugations that define said tubular chambers.

10. The package according to claim 6, wherein said walls are made of paper coupled internally with a film of thermoplastic material wherein said tubular chambers are formed by a corrugated sheet of thermoplastic material heat-welded to said film along its edges and along its corrugations that define said tubular chambers.

11. The package according to claim 6, wherein said walls are made of thermoplastic material, wherein said tubular chambers are formed by a corrugated sheet of thermoplastic material heat-welded to said walls along its edges and along its corrugations that define said tubular chambers.

12. The package according to claim 1, wherein said walls are made of paper coupled internally with a film of thermoplastic material wherein said tubular chambers are formed by a corrugated sheet of thermoplastic material heat-welded to said film along its edges and along its corrugations that define said tubular chambers.

13. The package according to claim 1, wherein said walls are made of thermoplastic material, wherein said tubular chambers are formed by a corrugated sheet of thermoplastic material heat-welded to said walls along its edges and along its corrugations that define said tubular chambers.

14. The package according to claim 1, further comprising an open end for introducing and extracting contents and a closed opposite end, said first tubular chambers and said second tubular chambers extending between said open end and said closed end longitudinally relative to said walls, such that interiors of said first tubular chambers and said second tubular chambers are not in fluid communication with each other, said closed end abutting first ends of said first tubular chambers and second ends of said second tubular chambers, and said first ends and said second ends directly abutting each other at said closed end.

* * * * *